US011250766B2

(12) United States Patent
Tokumasu

(10) Patent No.: US 11,250,766 B2
(45) Date of Patent: Feb. 15, 2022

(54) SEMICONDUCTOR APPARATUS

(71) Applicant: ROHM CO., LTD., Kyoto (JP)

(72) Inventor: Seiji Tokumasu, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 17/080,187

(22) Filed: Oct. 26, 2020

(65) Prior Publication Data

US 2021/0043133 A1 Feb. 11, 2021

Related U.S. Application Data

(63) Continuation of application No. PCT/JP2019/016632, filed on Apr. 18, 2019.

(30) Foreign Application Priority Data

Apr. 26, 2018 (JP) ..... JP2018-085777

(51) Int. Cl.
*G09G 3/30* (2006.01)
*G09G 3/36* (2006.01)
(Continued)

(52) U.S. Cl.
CPC ..... *G09G 3/32* (2013.01); *G09G 3/006* (2013.01); *G09G 3/204* (2013.01); *G09G 2370/08* (2013.01); *G09G 2380/10* (2013.01)

(58) Field of Classification Search
CPC ..... G09G 3/296; G09G 3/3266–3291; G09G 3/3611–3696; G09G 2310/02–0297
See application file for complete search history.

(56) References Cited

U.S. PATENT DOCUMENTS

2010/0214280 A1 8/2010 Kim
2010/0259523 A1* 10/2010 Huang ..... G09G 3/3688 345/211
2018/0033353 A1* 2/2018 Kim ..... G09G 3/20

FOREIGN PATENT DOCUMENTS

JP 2009171183 A 7/2009
JP 2010107933 A 5/2010
(Continued)

OTHER PUBLICATIONS

International Search Report for International Application No. PCT/JP2019/016632; dated Jul. 23, 2019.
(Continued)

*Primary Examiner* — Sanghyuk Park
(74) *Attorney, Agent, or Firm* — Cantor Colburn LLP

(57) ABSTRACT

A first receiver receives serial data including multiple odd-numbered pixels arranged horizontally at odd-numbered positions in a frame. A second receiver receives serial data including multiple even-numbered pixels arranged horizontally at even-numbered positions in a frame. A signal processing unit integrates the multiple odd-numbered and even-numbered pixels, so as to generate line data. A first reception abnormal state detector detects an abnormal state in the first receiver. A second reception abnormal state detector detects an abnormal state in the second receiver. When the first reception abnormal state detector detects an abnormal state, the signal processing unit restores odd-numbered pixels using even-numbered pixels. When the second reception abnormal state detector detects an abnormal state, the signal processing unit restores even-numbered pixels using odd-numbered pixels.

15 Claims, 13 Drawing Sheets

(51) Int. Cl.

| | |
|---|---|
| ***G09G 3/32*** | (2016.01) |
| ***G09G 3/00*** | (2006.01) |
| ***G09G 3/20*** | (2006.01) |

(56) References Cited

FOREIGN PATENT DOCUMENTS

| | | | |
|---|---|---|---|
| JP | 2011150135 | A | 8/2011 |
| JP | 2015144392 | A | 8/2015 |

OTHER PUBLICATIONS

International Preliminary Report on Patentability and Written Opinion of the International Searching Authority for International Application No. PCT/JP2019/016632; dated Nov. 5, 2020.
JPO Notice of Reasons for Refusal for corresponding JP Application No. 2020-516287, dated Jun. 1, 2021.
JPO Notice of Reasons for Refusal for corresponding JP Application No. 2020-516287; dated Sep. 14, 2021.

* cited by examiner

SEMICONDUCTOR APPARATUS

CROSS REFERENCE TO PRIOR APPLICATIONS

This application is a continuation under 35 U.S.C. § 120 of PCT/JP2019/016632, filed Apr. 18, 2019, which is incorporated herein reference and which claimed priority to Japanese Application No. 2018-085777, filed Apr. 26, 2018. The present application likewise claims priority under 35 U.S.C. § 119 to Japanese Application No. 2018-085777, filed Apr. 26, 2018, the entire content of which is also incorporated herein by reference.

BACKGROUND

1. Technical Field

The present invention relates to a semiconductor apparatus including an interface that supports a digital video signal.

2. Description of the Related Art

FIG. 1 is a block diagram showing an image display system 100R. The image display system 100R includes a display panel 102 such as a liquid crystal panel, organic EL panel, or the like, a gate driver 104, a source driver 106, a graphics processor 110, and a timing controller 200. The graphics processor 110 generates video data to be displayed on the display panel 102. Pixel (RGB) data included in the video data is transmitted to the timing controller 200R in serial form. In a case in which the display panel 102 has a high resolution, the video data is transmitted such that each frame is divided into an odd-numbered pixel frame and an even-numbered pixel frame.

The timing controller 200R receives the video data, and generates various kinds of control/synchronization signals. The gate driver 104 sequentially selects scanning lines Ls of the display panel 102 in synchronization with a signal received from the timing controller 200R. The timing controller 200R supplies the RGB data of each of the pixels that form the frame data to the source driver 106.

The timing controller 200R includes two receivers 202*o* and 202*e*, a transmitter 204, and a signal processing unit 210. The receiver 202*o* receives odd-numbered pixels in serial form from the graphics processor 110. The receiver 202*e* receives even-numbered pixels in serial form from the graphics processor 110. The signal processing unit 210 integrates the pixel data received by the receivers 202*o* and 202*e* so as to reconstruct line data (or frame data). Furthermore, the signal processing unit 210 applies signal processing such as gamma correction or the like as necessary to the line data (frame data). Moreover, the signal processing unit 210 generates a control/synchronization signal based on the signal received from the graphics processor 110, and supplies the control/synchronization signal thus generated to the gate driver 104. The transmitter 204 outputs the frame data thus subjected to signal processing to the source driver 106.

FIG. 2 is a block diagram showing another image display system 100S. The display panel 102 is divided into multiple (two in this example) regions RGNa and RGNb in the horizontal direction. The regions RGNa and RGNb are provided with source drivers 106*a* and 106*b*, respectively.

The timing controller 200S includes multiple transmitters 204*a* and 204*b* that respectively correspond to the multiple source drivers 106*a* and 106*b*. The signal processing unit 210 divides each frame of video data to be displayed on the display panel 102 into the regions RGNa and RGNb, and supplies the respective items of video data thus divided to the transmitters 204*a* and 204*b*.

By investigating the image display system 100R and 100S shown in FIG. 1 and FIG. 2, the present inventor has recognized the following problem.

In a case of employing the image display system 100R shown in FIG. 1, when an abnormal state occurs in data transmission between the receiver 202*o* and the graphics processor 110 or data transmission between the receiver 202*e* and the graphics processor 110, the image display system 100R is not able to display a normal video image on the display panel 102. With conventional arrangements, in this case, a black monotone video image is displayed on the display panel 102. That is to say, in this case, such an arrangement has a problem of the occurrence of missing information to be displayed on the display panel 102.

In a case of employing the image display system 100S shown in FIG. 2, when an abnormal state occurs in any one of the multiple source drivers 106*a* and 106*b*, such an arrangement is not able to correctly display a video image for the region RGN # that corresponds to the source driver 106 # ("#" represents "a" or "b") in which an abnormal state has occurred. This leads to the occurrence of missing information.

Ad described above, with such image display systems 100R and 100S according to conventional techniques, when an abnormal state occurs, such an arrangement has a problem of a reduction of the information to be displayed on the display panel 102.

In particular, in a case in which such an image display system is employed as a cluster panel of an automobile, such a display panel displays a speedometer, tachometer, various kinds of emergency lamps, etc. If an abnormal situation occurs in which any one of such items cannot be displayed, this leads to difficulty in driving the vehicle. Also, in a case in which such an image display system is employed for a medical device, such a display panel displays very important information. Accordingly, there is a need to suppress the occurrence of information loss as much as possible.

SUMMARY

An embodiment of the present disclosure relates to a semiconductor apparatus. The semiconductor apparatus includes: a first receiver structured to receive serial data including data of multiple odd-numbered pixels positioned at odd-numbered positions in the horizontal direction in a frame; a second receiver structured to receive serial data including data of multiple even-numbered pixels positioned at even-numbered positions in the horizontal direction in a frame; a first reception abnormal state detector structured to detect an abnormal state that occurs in the first receiver; a second reception abnormal state detector structured to detect an abnormal state that occurs in the second receiver; and a signal processing unit structured to integrate the data of the multiple odd-numbered pixels and the data of the multiple even-numbered pixels so as to generate line data or frame data. When the first reception abnormal state detector detects an abnormal state, the signal processing unit restores the data of the odd-numbered pixels using the data of the even-numbered pixels. When the second reception abnormal state detector detects an abnormal state, the signal processing unit restores the data of the even-numbered pixels using the data of the data of the odd-numbered pixels.

Another embodiment of the present disclosure also relates to a semiconductor apparatus. The semiconductor apparatus includes: a receiver structured to receive video data; a signal processing unit structured to process the video data; multiple transmitters structured to transmit the video data processed by the signal processing unit to multiple source drivers; and a display abnormal state detector structured to detect whether or not an abnormal state occurs in each of the multiple source drivers. The signal processing unit rearranges the video data on a display panel in a region other than a region in which an abnormal state is detected, so as to distribute the video data thus rearranged to transmitters that correspond to source drivers that are operating normally.

It should be noted that any combination of the components described above or any manifestation according to the present disclosure, may be mutually substituted between a method, apparatus, and so forth, which are also effective as an embodiment of the present disclosure.

The description of the items (means for solving the problems) is by no means intended to describe all the indispensable features of the present disclosure. That is to say, any sub-combination of the features as described above is also encompassed in the technical scope of the present disclosure.

BRIEF DESCRIPTION OF THE DRAWINGS

The invention will now be described based on preferred embodiments which do not intend to limit the scope of the present invention but exemplify the invention. All of the features and the combinations thereof described in the embodiment are not necessarily essential to the invention.

DETAILED DESCRIPTION OVERVIEW OF THE EMBODIMENTS

Figure 1:
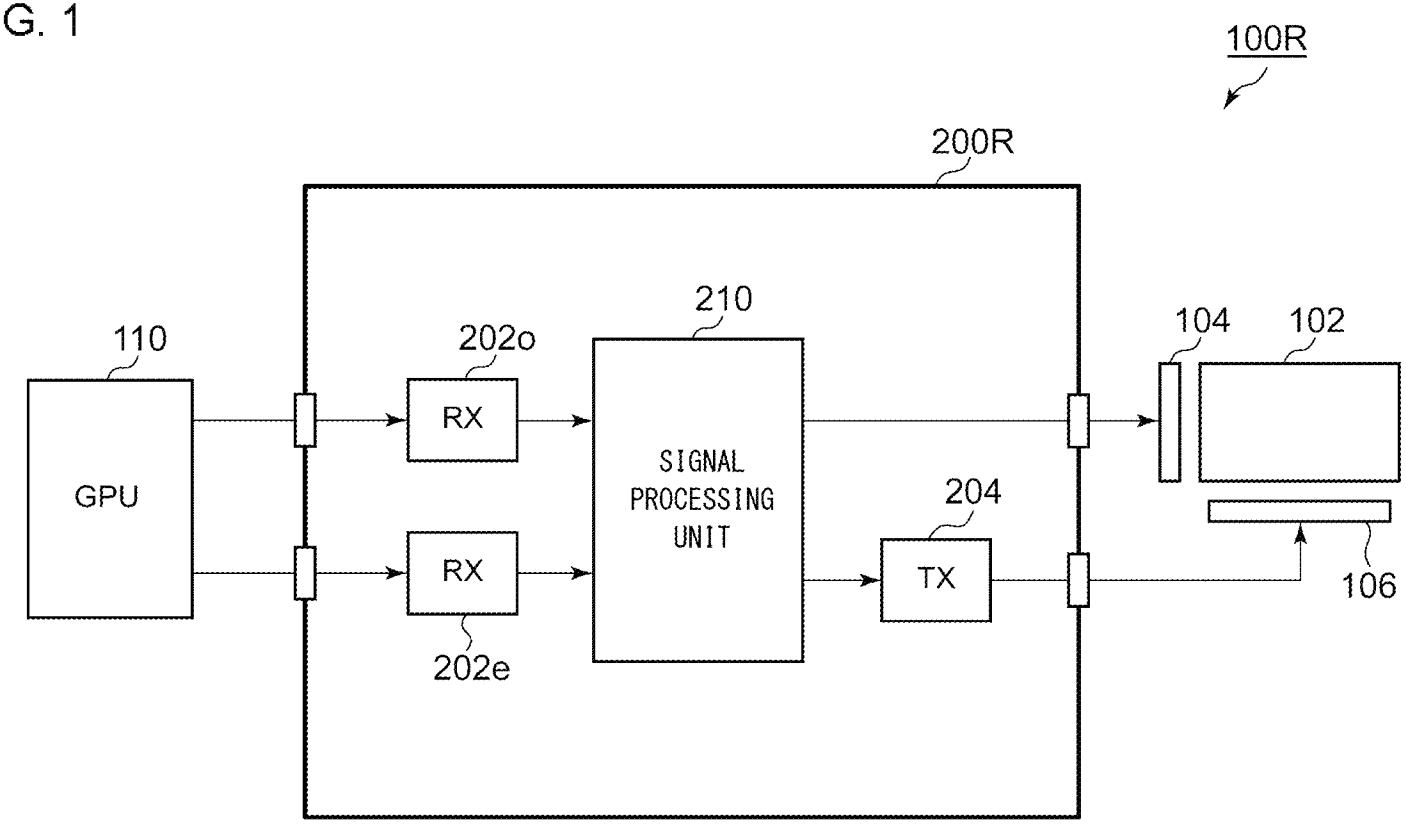
FIG. 1 is a block diagram showing an image display system.
Figure 2:
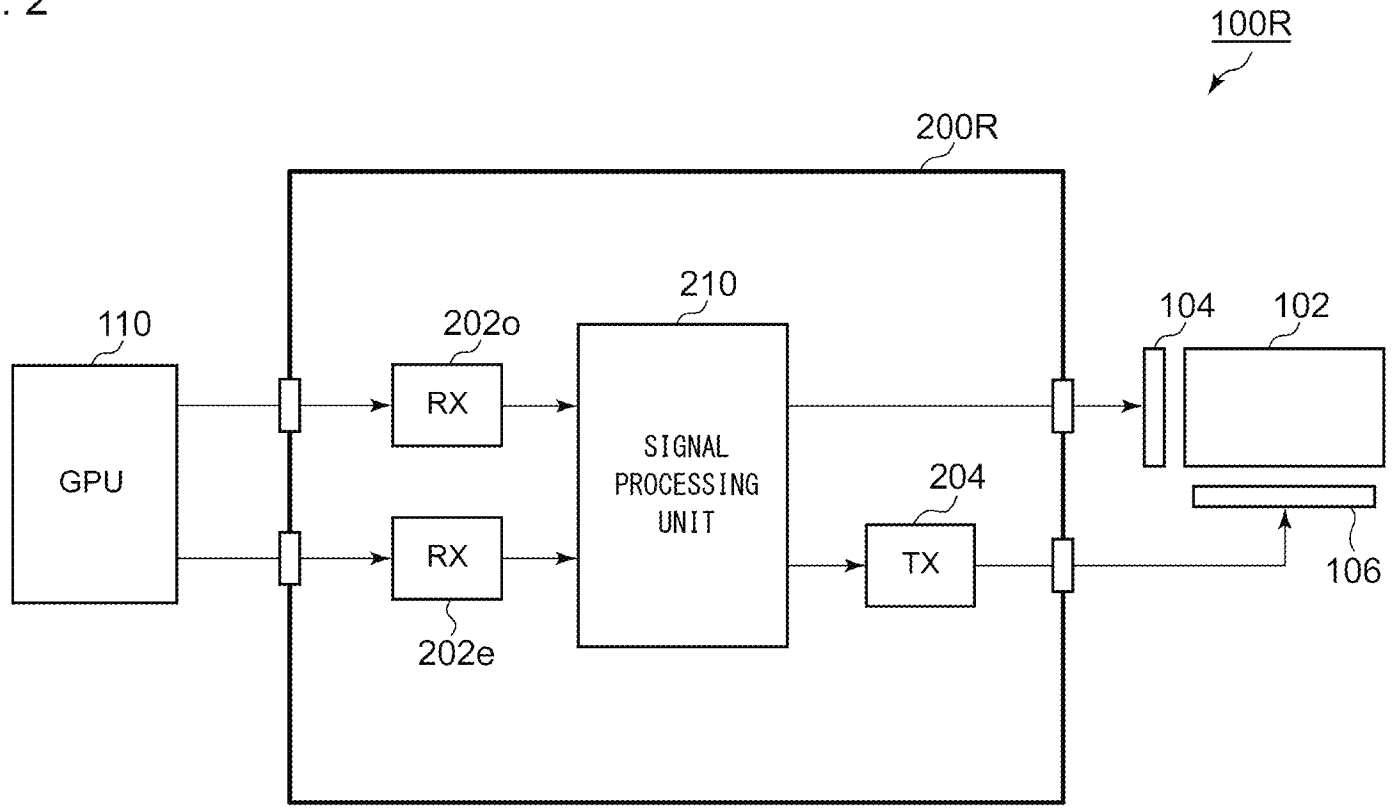
FIG. 2 is a block diagram showing another image display system.

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "one embodiment" may be used herein to refer to a single embodiment or multiple embodiments of the disclosure.

One embodiment disclosed in the present specification relates to a semiconductor apparatus. The semiconductor apparatus may be configured as a timing controller, a bridge Integrated Circuit (IC), or a one-chip driver.

The semiconductor apparatus includes: a first receiver structured to receive serial data including data of multiple odd-numbered pixels positioned at odd-numbered positions in the horizontal direction in a frame; a second receiver structured to receive serial data including data of multiple even-numbered pixels positioned at even-numbered positions in the horizontal direction in a frame; a signal processing unit structured to integrate the data of the multiple odd-numbered pixels and the data of the multiple even-numbered pixels, so as to generate line data or frame data; a first reception abnormal state detector structured to detect an abnormal state that occurs in the first receiver; and a second reception abnormal state detector structured to detect an abnormal state that occurs in the second receiver. When the first reception abnormal state detector detects an abnormal state, the signal processing unit restores the data of the odd-numbered pixels using the data of the even-numbered pixels. When the second reception abnormal state detector detects an abnormal state, the signal processing unit restores the data of the even-numbered pixels using the data of the data of the odd-numbered pixels.

In many cases, an odd-numbered pixel and an even-numbered pixel adjacent to each other have a similar value. Based on this fact, when an abnormal state occurs in any one from among the two transmission channels for transmitting the two items of serial data, the pixel data in which an abnormal state has occurred can be restored based on the other pixel data received normally via the transmission channel that operates normally. This suppresses reduction in the information displayed on the display panel.

In one embodiment, (i) when the first reception abnormal state detector detects an abnormal state, the signal processing unit may restore the odd-numbered pixels such that, as a restored value of an odd-numbered pixel, a value of an even-numbered pixel adjacent to the corresponding odd-numbered pixel is employed. Also, (ii) when the second reception abnormal state detector detects an abnormal state, the signal processing unit may restore the even-numbered pixels such that, as a restored value of an even-numbered pixel, a value of an odd-numbered pixel adjacent to the corresponding even-numbered pixel is employed. In this case, the resolution in the horizontal direction is reduced to substantially half the original resolution. However, this arrangement requires only simple processing to maintain the image display.

In one embodiment, (i) when an abnormal state is detected in the first receiver, the signal processing unit may restore the odd-numbered pixels such that, as a restored value of an odd-numbered pixel, a value obtained by calculating values of two even-numbered pixels adjacent to the corresponding odd-numbered pixel is employed. Also, (ii) when an abnormal state is detected in the second receiver, the signal processing unit may restore the even-numbered pixels such that, as a restored value of an even-numbered pixel, a value obtained by calculating values of two odd-numbered pixels adjacent to the corresponding even-numbered pixel is employed. Examples of such calculation include averaging, interpolation, etc. This arrangement is capable of suppressing degradation in the image quality.

In one embodiment, the serial data may be transmitted together with a clock signal. Also, the first reception abnormal state detector and the second reception abnormal state detector may each be structured to detect an abnormal state based on the presence or absence of the clock signal and/or the frequency of the clock signal.

In one embodiment, the first reception abnormal state detector and the second reception abnormal state detector may each be structured to detect an abnormal state based on a predetermined code included in the serial data.

In one embodiment, the predetermined code may be a synchronization code to be used for link training. This arrangement is capable of detecting a broken link. Also, the predetermined code may be a unique code included in each blank period.

In one embodiment, the semiconductor apparatus may further include: multiple transmitters structured to transmit the line data to multiple source drivers; and a display anormal state detector structured to detect whether or not an abnormal state occurs in each of the multiple source drivers. Also, the signal processing unit may rearrange the line data on a display panel in a region other than a region in which an abnormal state has been detected so as to distribute the line data thus rearranged to transmitters that correspond to source drivers that are operating normally. In other words, the signal processing unit may distribute a part of line data to be distributed to the transmitter that correspond to the source driver in which an abnormal state has been detected to the transmitters that correspond to the source drivers that are operating normally.

With this arrangement, the information to be displayed in a region where no image can be displayed is assigned to a different region, thereby allowing such information to be displayed. This arrangement is capable of suppressing a reduction in information displayed on the display panel.

In one embodiment, the signal processing unit may scale the line data, and may distribute the line data thus scaled to the transmitters that correspond to the source drivers that are operating normally. This arrangement requires only simple processing to suppress a reduction in the information displayed on the display panel.

In one embodiment, when either the first reception abnormal state detector or the second reception detector detects an abnormal state, the signal processing unit may change the color appearance or luminance of an image. In a case in which an icon or the like is displayed on a display using an On Screen Display (OSD) function in order to notify the user of the occurrence of an abnormal state as with conventional techniques, such an arrangement has a problem of involving the occurrence of missing information in a region where the icon overlaps. In contrast, in a case in which, when an abnormal state is detected, the color appearance or the luminance is changed, this arrangement is capable of notifying the user of the occurrence of an abnormal state while preventing the occurrence of missing information. Also, the signal processing unit may change the color appearance or luminance over time. This allows further attraction of the attention of the user.

One embodiment of the present disclosure also relates to a semiconductor apparatus. The semiconductor apparatus includes: a receiver structured to receive video data; a signal processing unit structured to process the video data; multiple transmitters structured to transmit the video data processed by the signal processing unit to multiple source drivers; and a display abnormal state detector structured to detect whether or not an abnormal state occurs in each of the multiple source drivers. The signal processing unit rearranges the video data on a display panel in a region other than a region in which an abnormal state is detected, so as to distribute the video data thus rearranged to transmitters that correspond to source drivers that are operating normally.

In one embodiment, the signal processing unit may scale the video data, and may distribute the video data thus scaled to the transmitters that correspond to the source drivers that are operating normally.

In one embodiment, when the display abnormal state detector detects an abnormal state, the signal processing unit may change the color appearance or luminance of the video data.

EMBODIMENTS

Description will be made below regarding the present invention based on preferred embodiments with reference to the drawings. The same or similar components, members, and processes are denoted by the same reference numerals, and redundant description thereof will be omitted as appropriate. The embodiments have been described for exemplary purposes only, and are by no means intended to restrict the present invention. Also, it is not necessarily essential for the present invention that all the features or a combination thereof be provided as described in the embodiments.

In the present specification, a state represented by the phrase "the member A is coupled to the member B" includes a state in which the member A is indirectly coupled to the member B via another member that does not substantially affect the electric connection between them, or that does not damage the functions of the connection between them, in addition to a state in which they are physically and directly coupled.

Similarly, a state represented by the phrase "the member C is provided between the member A and the member B" includes a state in which the member A is indirectly coupled to the member C, or the member B is indirectly coupled to the member C via another member that does not substantially affect the electric connection between them, or that does not damage the functions of the connection between them, in addition to a state in which they are directly coupled.

First Embodiment

Figure 3:
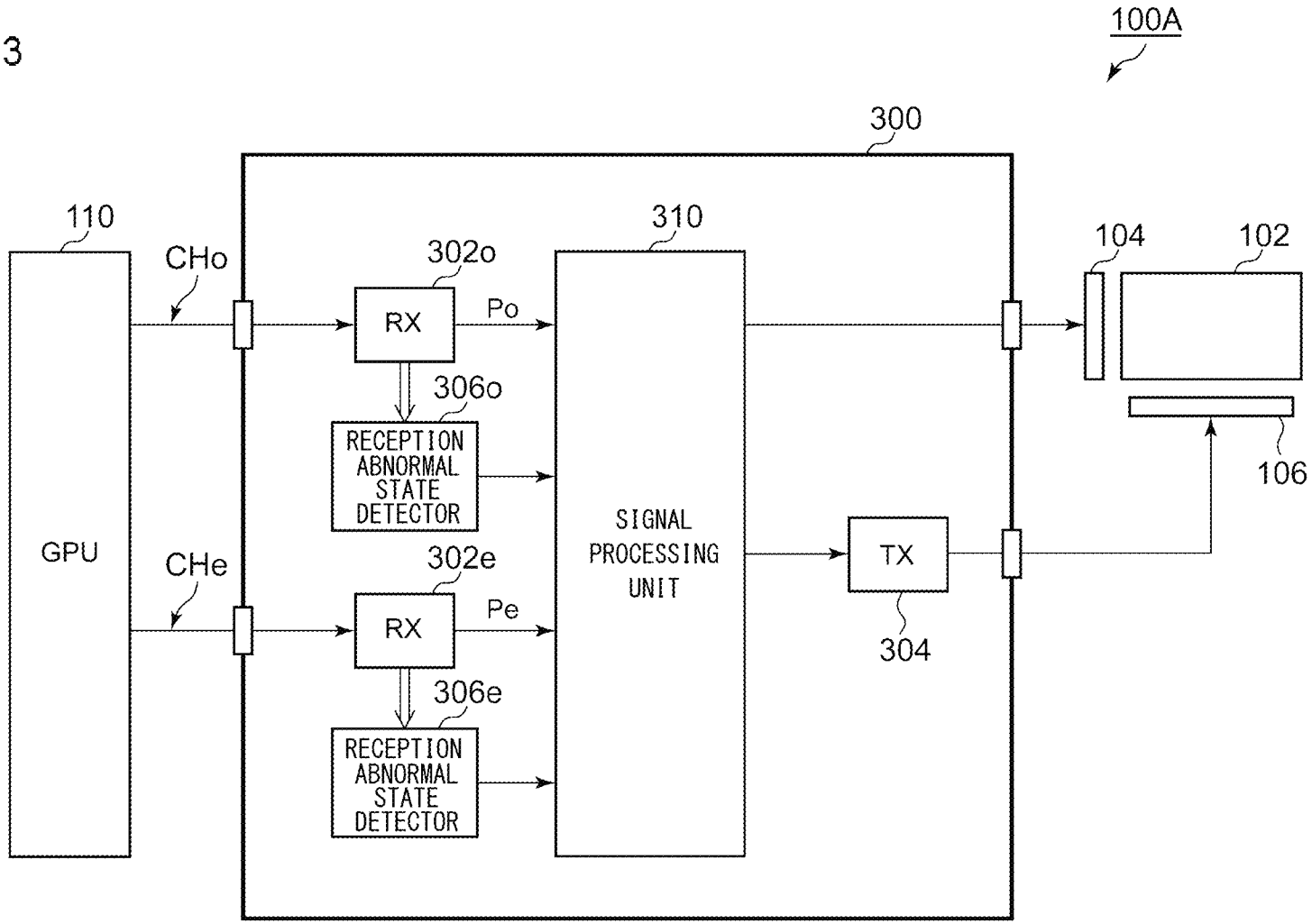
FIG. 3 is a block diagram showing an image display system according to a first embodiment.

FIG. 3 is a block diagram showing an image display system 100A according to a first embodiment. The image display system 100A includes a display panel 102, a gate driver 104, a source driver 106, a graphics processor 110, and a semiconductor apparatus 300.

The graphics processor 110 is configured as a Graphics Processing Unit (GPU) or the like, and generates video data to be displayed on the display panel 102. The graphics processor 110 includes a transmitter that conforms to the HDMI (trademark) standard, DisplayPort standard, Low-voltage Differential Signaling (LVDS) Digital Visual Interface (DVI) standard, or the like. The graphics processor 110 transmits a digital video signal including video data to the semiconductor apparatus 300 in serial form.

Figure 4A:
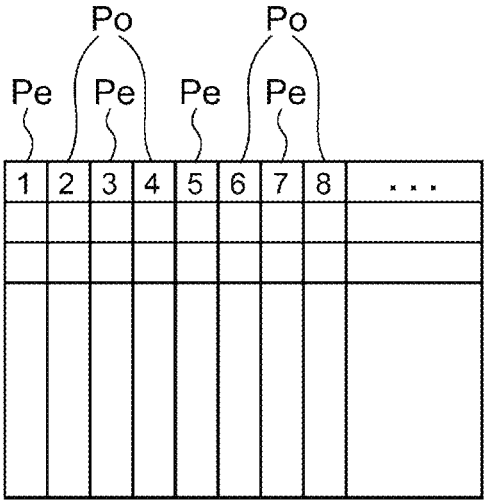
FIG. 4A and FIG. 4B are diagrams for explaining odd-numbered pixels and even-numbered pixels and data transmission thereof.
Figure 4B:
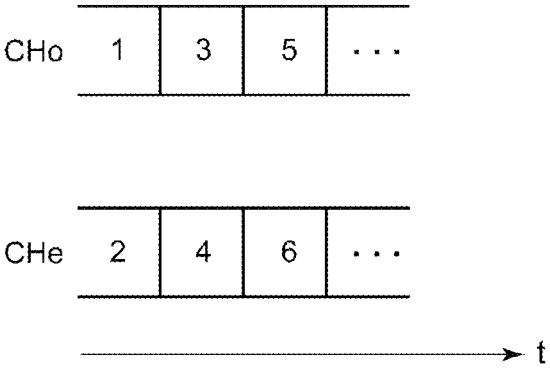

FIG. 4A and FIG. 4B are diagrams for explaining odd-numbered pixels and even-numbered pixels and data transmission thereof. As shown in FIG. 4A, pixels each arranged at an odd-numbered position along the horizontal direction in each frame (i.e., first pixel, third pixel, fifth pixel, seventh pixel, . . . ) will be denoted by "odd-numbered pixels Pe". On the other hand, pixels each arranged at an even-numbered position along the horizontal direction in each frame (i.e., second pixel, fourth pixel, sixth pixel, eighth pixel, . . . ) will be denoted by "even-numbered pixels Po". As shown in FIG. 4B, with the system 100A, the odd-numbered pixel data Pe and the even-numbered pixel data Po are transmitted on separate channels Cho and Che.

Returning to FIG. 3, the semiconductor apparatus 300 includes a first receiver 302*o*, a second receiver 302*e*, a transmitter 304, a first reception abnormal state detector 306*o*, a second reception abnormal state detector 306*e*, and a signal processing unit 310. The semiconductor apparatus 300 is configured as an Integrated Circuit (IC) integrated on a single semiconductor substrate, which is referred to as a so-called "timing controller".

The first receiver 302*o* and the second receiver 302*e* are each configured as a serial interface that is capable of receiving video data. The first receiver 302*o* receives serial data that supports multiple odd-numbered pixels positioned at odd-numbered positions in the horizontal direction for each frame. The second receiver 302*e* receives serial data that supports multiple even-numbered pixels positioned at even-numbered positions in the horizontal direction for each frame.

The signal processing unit 310 integrates data of the odd-numbered pixels Pe received by the first receiver 302*o* and the data of the even-numbered pixels Po received by the second receiver 302*e*, so as to reconstruct the line data LD.

The first reception abnormal state detector 306*o* detects the occurrence of an abnormal state in the receiver 302*o*. Similarly, the second reception abnormal state detector 306*e* detects the occurrence of an abnormal state in the second receiver 302*e*. The abnormal state detection method is not restricted in particular. For example, the following methods may be employed.

In a case in which serial transmission from the graphics processor 110 to the semiconductor apparatus 300 is supported using a source-synchronous method, the occurrence of an abnormal state can be detected based on a clock signal CK. For example, when the clock signal CK cannot be received for a predetermined period of time, judgement may be made that an abnormal state has occurred. Also, the frequency of the received clock signal CK may be monitored. When the frequency of the clock signal CK thus received deviates from a predetermined frequency, judgment may be made that an abnormal state has occurred.

In a case in which the serial transmission is supported using an embedded clock method or Clock Data Recovery (CDR) method, the occurrence of an abnormal state can be detected based on a predetermined code included in the serial data. For example, in a case of employing 8b10b encoding, the serial data includes a data symbol that is referred to as a "D code" and a control symbol that is referred to as a "K code". In this case, when the control symbol cannot be received correctly, judgement may be made that an abnormal state has occurred. As the predetermined code, a synchronization code used for link training may be employed.

Alternatively, a unique code in the video data may be used to make judgment regarding whether or not an abnormal state has occurred. A transmission protocol such as HDMI or the like supports serial data including a data enable (DE) signal, a vertical synchronization (VS) signal, and a horizontal synchronization (HS) signal, in addition to RGB pixel data. Such signals are each configured as a unique code included in each blank period. With such an arrangement, at least one from among the DE signal, VS signal, and HS signal may be monitored. Also, when the signal thus monitored cannot be received normally, judgment may be made that an abnormal state has occurred.

When the first reception abnormal state detector 306*o* detects the occurrence of an abnormal state, i.e., when data of the odd-numbered pixels Pe cannot be received correctly due to the occurrence of an abnormal state in the channel CHe, the data of the odd-numbered pixels Pe is restored using the data of the even-numbered pixels Po. The signal processing unit 310 integrates the data of the odd-numbered pixels Pe thus restored and the data of the even-numbered pixels Po received normally.

Conversely, when the second reception abnormal state detector 306*e* detects the occurrence of an abnormal state, i.e., when the data of the even-numbered pixels Po cannot be received correctly due to the occurrence of an abnormal state in the channel CHo, the data of the even-numbered pixels Po is restored using the data of the odd-numbered pixels Pe. The signal processing unit 310 integrates the data of the even-numbered pixels Po thus restored and the data of the odd-numbered pixels Pe received normally.

The transmitter 304 transmits the pixel data thus integrated to the source driver 106. Furthermore, the signal processing unit 310 transmits the control signals and synchronization signals to the gate driver 104.

Figure 5:
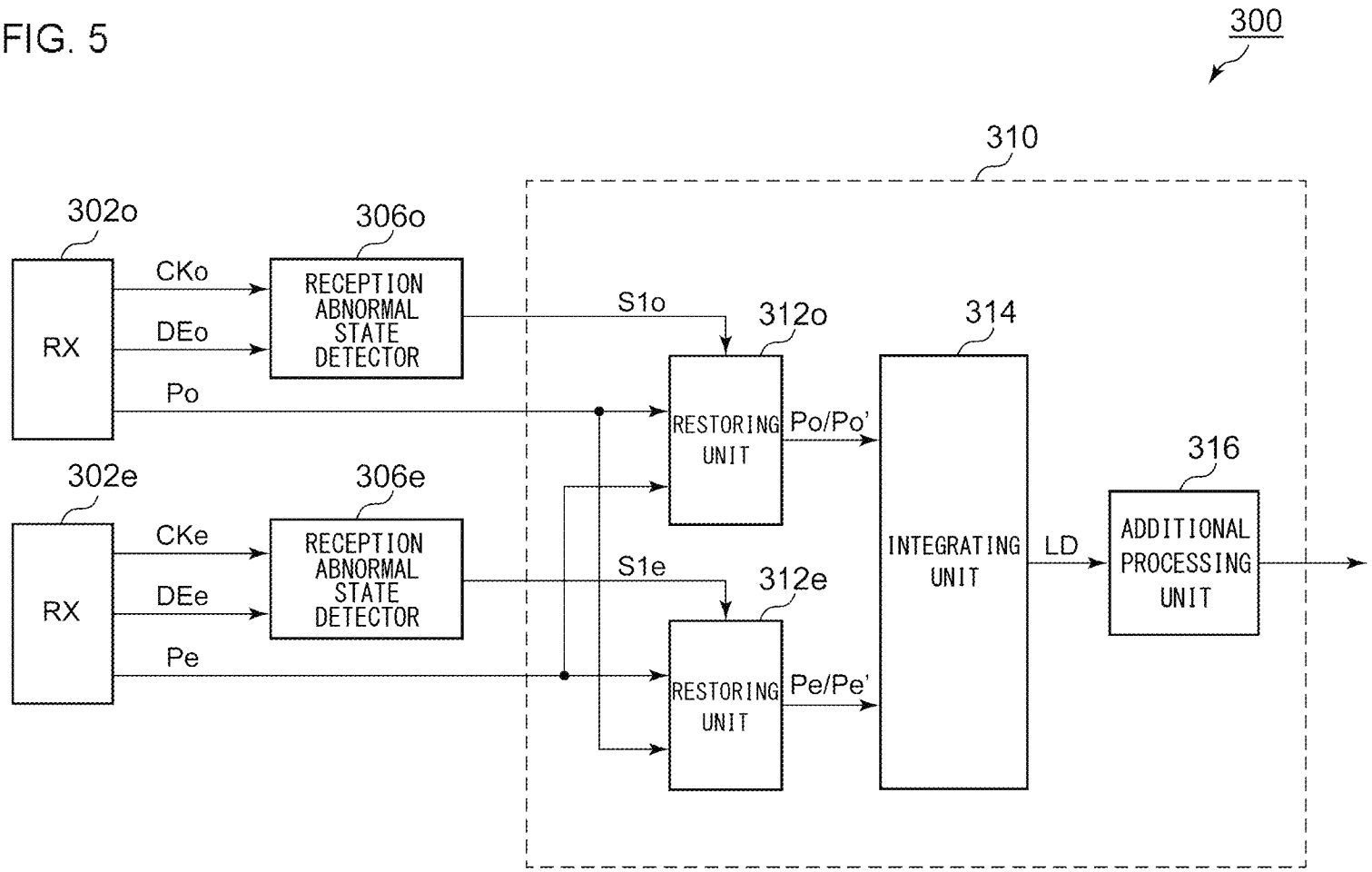
FIG. 5 is a block diagram showing a specific example configuration of a timing controller.

FIG. 5 is a block diagram showing a specific example configuration of the semiconductor apparatus 300. The signal processing unit 310 includes a first restoring unit 312*o*, a second restoring unit 312*e*, an integrating unit 314, and an additional processing unit 316.

FIG. 5 shows an example using the source-synchronous method. The first abnormal state detector 306*o* is capable of detecting the occurrence of an abnormal state based on the clock signal CKo and the DE signal DEo. Upon detecting the occurrence of an abnormal state, the first reception abnormal state detector 306*o* asserts (e.g., set to the high level) an abnormal state detection signal S1*o*. Similarly, the second reception abnormal state detector 306*e* is capable of detecting the occurrence of an abnormal state based on the clock signal CKe and the DE signal DEe. Upon detecting the occurrence of an abnormal state, the second reception abnormal state detector 306*e* asserts an abnormal state detection signal S1*e*.

The first restoring unit 312*o* receives, as its input data, the data of the odd-numbered pixels Po received by the first receiver 302*o* and the data of the even-numbered pixels Pe received by the second receiver 302*e*. When the abnormal state detection signal S1*o* is negated, the first restoring unit 312*o* outputs the data of the odd-numbered pixels Po as it is. When the abnormal state detection signal S1*o* is asserted, the first restoring unit 312*o* outputs the data of the odd-numbered pixels Po' restored using the data of the even-numbered pixels Pe.

The second restoring unit 312*e* receives, as its input data, the data of the even-numbered pixels Pe received by the second receiver 302*e* and the data of the odd-numbered pixels Po received by the first receiver 302*o*. When the abnormal state detection signal S1*e* is negated, the second restoring unit 312*e* outputs the data of the even-numbered pixels Pe as it is. When the abnormal state detection signal S1*e* is asserted, the second restoring unit 312*e* outputs the data of the even-numbered pixels Pe' restored using the data of the odd-numbered pixels Po.

The integrating unit 314 integrates the output of the first restoring unit 312*o* and the output of the second restoring unit 312*e* so as to generate line data (frame data) LD. The additional processing unit 316 may apply processing such as gamma correction or the like to the line data LD.

Figure 6A:
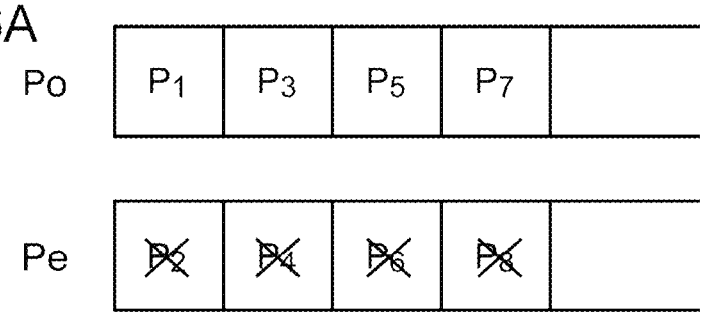
FIG. 6A through FIG. 6C are diagrams for explaining the restoring of pixel data.
Figure 6B:
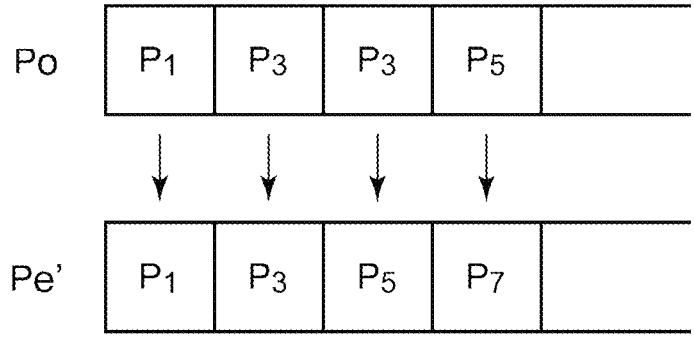
Figure 6C:
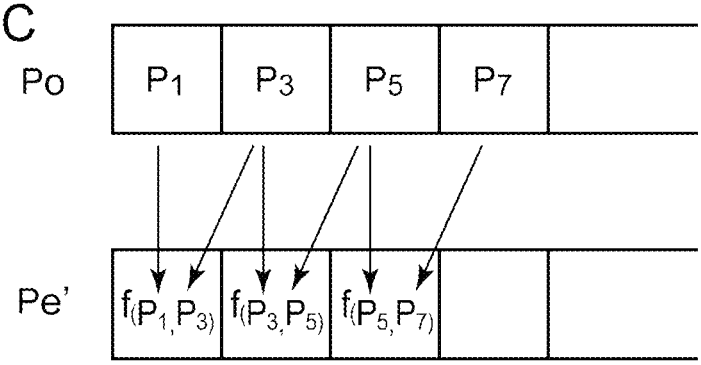

FIG. 6A through FIG. 6C are diagrams for explaining the restoring of the pixel data. As shown in FIG. 6A, description will be made regarding an example in which an abnormal state occurs in the even-numbered pixels. Here, "$P_{\#}$" ("#" represents "1", "2", "3", . . . ) represents the pixel value of the #-th pixel.

FIG. 6B shows a first restoring method. When the second reception abnormal state detector 306*e* detects the occurrence of an abnormal state, i.e., when an abnormal state occurs in the even-numbered pixels Pe, as the value of each even-numbered pixel Pe' thus restored, the value of the odd-numbered pixel Po adjacent to the corresponding even-numbered pixel Pe is employed. Conversely, when the first reception abnormal state detector 306*o* detects the occurrence of an abnormal state, i.e., when an abnormal state occurs in the odd-numbered pixels Po, as the value of each odd-numbered pixel Po' thus restored, the value of the even-numbered pixel Pe adjacent to the corresponding odd-numbered pixel Po is employed.

FIG. 6C shows a second restoring method. When the second reception abnormal state detector 306*e* detects the occurrence of an abnormal state, i.e., when an abnormal state occurs in the even-numbered pixels, as the value of each even-numbered pixel Pe' thus restored, a value obtained by calculation with the values of two odd-numbered pixels Po adjacent to the corresponding even-numbered pixel Pe is employed. When the i-th even-numbered pixel is to be restored, with the value of the adjacent odd-numbered pixel to the left of the i-th even-numbered pixel as $P_{i-1}$, and with the value of the adjacent odd-numbered pixel to the right of the i-th even-numbered pixel as $P_{i+1}$, the restored pixel value $P_i'$ is represented by a function f( ) with $P_{i-1}$ and $P_{i+1}$ as arguments as follows.

$$P_i = f(P_{i-1}, P_{i+1})$$

Here, as the function f( ) simple averaging or weighted averaging may be employed. Also, other kinds of interpolation functions may be employed.

Conversely, when the second reception abnormal state detector 306*o* detects the occurrence of an abnormal state, i.e., when an abnormal state occurs in the odd-numbered pixels, as the value of each odd-numbered pixel Po' thus restored, a value obtained by calculation with the values of two even-numbered pixels Pe adjacent to the corresponding odd-numbered pixel Po is employed.

The above is the configuration of the image display system 100A. The odd-numbered pixels and the even-numbered pixels are adjacent to each other. Thus, in many cases, the adjacent odd-numbered and even-numbered pixels have similar pixel values. Based on this fact, with the semiconductor apparatus 300 according to the first embodiment, when an abnormal state occurs in any one of the two serial data transmission channels, the pixel data in which an abnormal state has occurred is restored based on the other pixel data received normally via the transmission channel that operates normally. This allows a problem of the occurrence of blackout in the display panel to be avoided. Accordingly, this suppresses reduction in the information displayed on the display panel.

Second Embodiment

Figure 7:
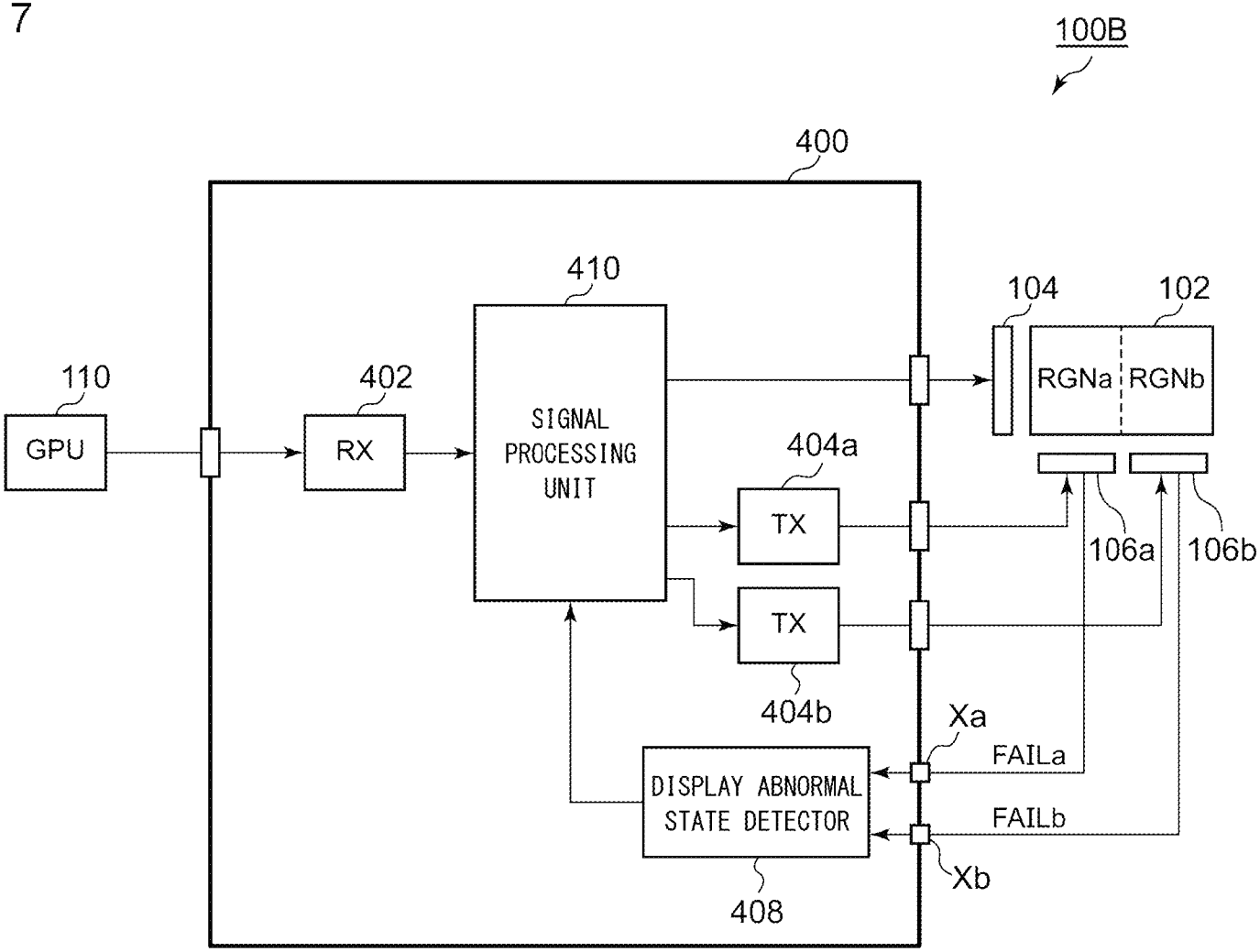
FIG. 7 is a block diagram showing an image display system according to a second embodiment.

FIG. 7 is a block diagram showing an image display system 100B according to a second embodiment. The image display system 100B includes a display panel 102, a gate driver 104, multiple source drivers 106*a* and 106*b*, a graphics processor 110, and a semiconductor apparatus 400.

The display panel 102 is divided into multiple regions RGNa and RGBb in the horizontal direction. A source driver is provided for each region. Description will be made regarding an example in which two source drivers are provided. However, the present disclosure is not restricted to such an example. That is to say, the present disclosure is also applicable to a system including three or more source drivers.

The semiconductor apparatus 400 is configured as a timing controller. The semiconductor apparatus 400 receives video data from the graphics processor 110, and controls the gate driver 104 and the source drivers 106*a* and 106*b*.

The semiconductor apparatus 400 includes a receiver 402, transmitters 404*a* and 404*b*, a display abnormal state detector 408, and a signal processing unit 410. The receiver 402 receives video data (specifically, pixel data, line data formed of multiple items of pixel data, and frame data formed of multiple items of line data) from the graphics processor 110. In a case in which the number of pixels that form the video data (one frame) is large, the video data may be divided into odd-numbered pixel data and even-numbered pixel data. The odd-numbered pixel data and the even-numbered pixel data thus divided may be transmitted via two respective channels. In this case, the receiver 402 includes two receivers.

The signal processing unit 410 processes the video data. The multiple transmitters 404*a* and 404*b* are assigned to the multiple source drivers 106*a* and 106*b*. The signal processing unit 410 distributes processed video data to the multiple transmitters 404*a* and 404*b*. The transmitters 404*a* and 404*b* transmit the video data thus distributed to the corresponding source drivers 106*a* and 106*b*.

The display abnormal state detector 408 is configured to be capable of detecting whether or not an abnormal state has occurred in each of the multiple source drivers 106*a* and 106*b*. For example, the source drivers 106*a* and 106*b* each have an abnormal state detection function. Examples of an abnormal state to be detected by each source driver 106 include at least one from among an abnormal state that occurs in the display panel 102, an abnormal state that occurs in an internal component of the source driver 106, and an abnormal state that occurs in serial transmission between the source driver 106 and the transmitter 404.

Each source driver 106 includes a fail (FAIL) pin. Upon detecting an abnormal state, the source driver 106 asserts a FAIL signal that occurs at a fail pin. The FAIL pin of the source driver 106 is coupled to an open-drain (open-collector) output stage, for example. Upon detecting an abnormal state, the source driver 106 may pull down the FAIL pin. The semiconductor apparatus 400 may include two fail detection pins Xa and Xb that correspond to two fail pins (fail signals) FAILa and FAILb.

The source drivers 106*a* and 106*b* may each be configured to output a FAIL signal in response to an inquiry received from the semiconductor apparatus 400. In this case, the fail detection pins Xa and Xb on the semiconductor apparatus 400 side may be configured as a single common fail detection pin. Also, the signal fail detection pin thus configured may be coupled to the fail pins FAILa and FAILb of the multiple source drivers 106. With such an arrangement, the semiconductor apparatus 400 is configured to make inquiries to the multiple source drivers 106*a* and 106*b* in a time-sharing manner. Such an arrangement requires only a single fail detection pin to judge whether or not an abnormal state has occurred in each of the multiple source drivers 106*a* and 106*b*.

Alternatively, in a case in which the semiconductor apparatus 400 and the source driver 106 are coupled via an Inter IC ($I^2C$) interface or a Serial Peripheral Interface (SPI), the source driver 106 may write the presence or absence of an abnormal state to an internal register. Also, the semiconductor apparatus 400 may access the register so as to read the presence or absence of an abnormal state.

The display abnormal state detector 408 notifies the signal processing unit 410 of whether or not an abnormal state has occurred with respect to each of the multiple source drivers 106*a* and 106*b*. Now, let us consider a case in which an abnormal state has been detected in the source driver 106 # ("#"="a" or "b"), and the other source driver 106!# operates normally. In this case, the signal processing unit 410 rearranges the line data (i.e., frame data) on the display panel 102 in the region RGB!# other than the region RGN # that corresponds to the source driver 106 # in which an abnormal state has been detected. Furthermore, the line data thus rearranged is distributed to the corresponding transmitter 404!# that corresponds to the source driver RGN!# which is operating normally.

In other words, the signal processing unit 410 distributes a part of the line data, which is to be distributed to the transmitter 404 # that corresponds to the source driver 106 # in which an abnormal state has been detected, to the transmitter 404!# that corresponds to the source driver 106!# which is operating normally.

Figure 8A:
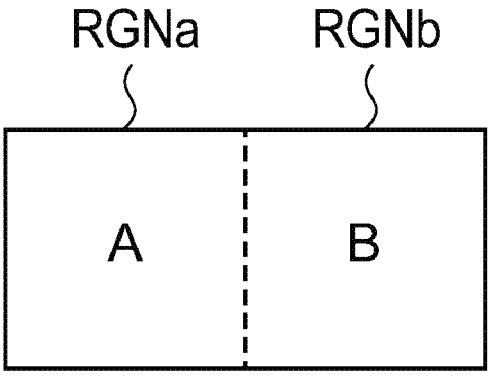
FIG. 8A through FIG. 8D are diagrams for explaining the operation of the timing controller shown in FIG. 7.

The above is the configuration of the image display system 100B. Next, description will be made regarding the operation thereof. FIG. 8A through FIG. 8D are diagrams for explaining the operation of the semiconductor apparatus 400 shown in FIG. 7. FIG. 8A shows the frame data when all the source drivers 106*a* and 106*b* operate normally. In this case, images A and B are displayed in the regions RGNa and RGNb, respectively.

Figure 8B:
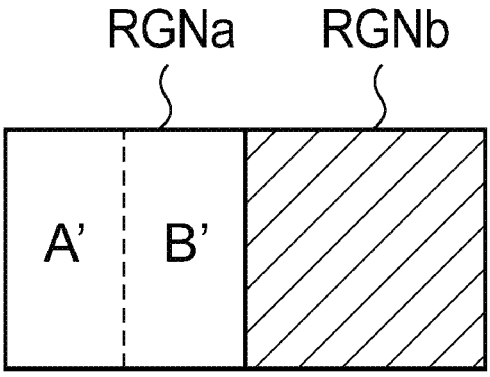
Figure 8C:
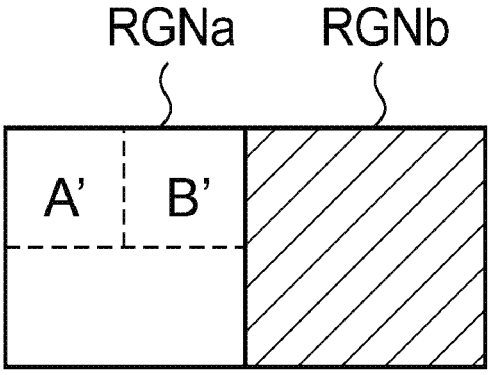
Figure 8D:
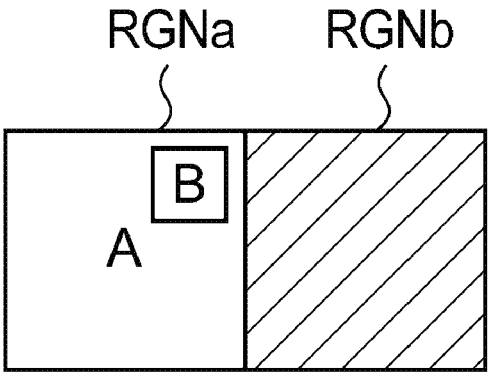

FIG. 8B through FIG. 8D are diagrams for explaining the rearrangement of the video data (line data or frame data) when an abnormal state has been detected. Description will be made regarding an example in which an abnormal state has been detected in the source driver 106*b*, leading to a situation in which no image can be displayed in the region RGNb. With an example, as shown in FIG. 8B, the images A and B may be scaled by a factor of ½ in only the horizontal direction. The images A' and B' thus scaled may be rearranged in the region RGNa which is operating normally. In this case, there is a difference in the aspect ratio between the images A' and B' and the original images A and B. However, this allows all the information to be displayed. This arrangement supports scaling in units of lines, thereby providing an advantage of allowing a required buffer capacity to be reduced.

With another example, as shown in FIG. 8C, the images A and B may be scaled in both the horizontal direction and the vertical direction so as to maintain the same aspect ratio as that of the original images A and B. The images A" and B" thus scaled may be rearranged in the region RGNa which is operating normally. In this case, the images A" and B" each have a reduced size. However, the aspect ratio is maintained for each of the images A" and B". This example requires a buffer for storing one frame.

With yet another example, the image B may be reduced as shown in FIG. 8C, and the image B'" thus reduced may be overlayed on the image A in a picture-in-picture manner. In a case in which the image B contains relatively more important information than the image A, the image B may be laid out in the entire region RGNa, and the image A may be reduced and the reduced image A'" may be overlaid on the image B in a picture-in-picture manner.

Conversely, when no image can be displayed in the region RGNa, processing that is the reverse of the processing shown in FIG. 8B through FIG. 8D may be executed.

Figure 9:
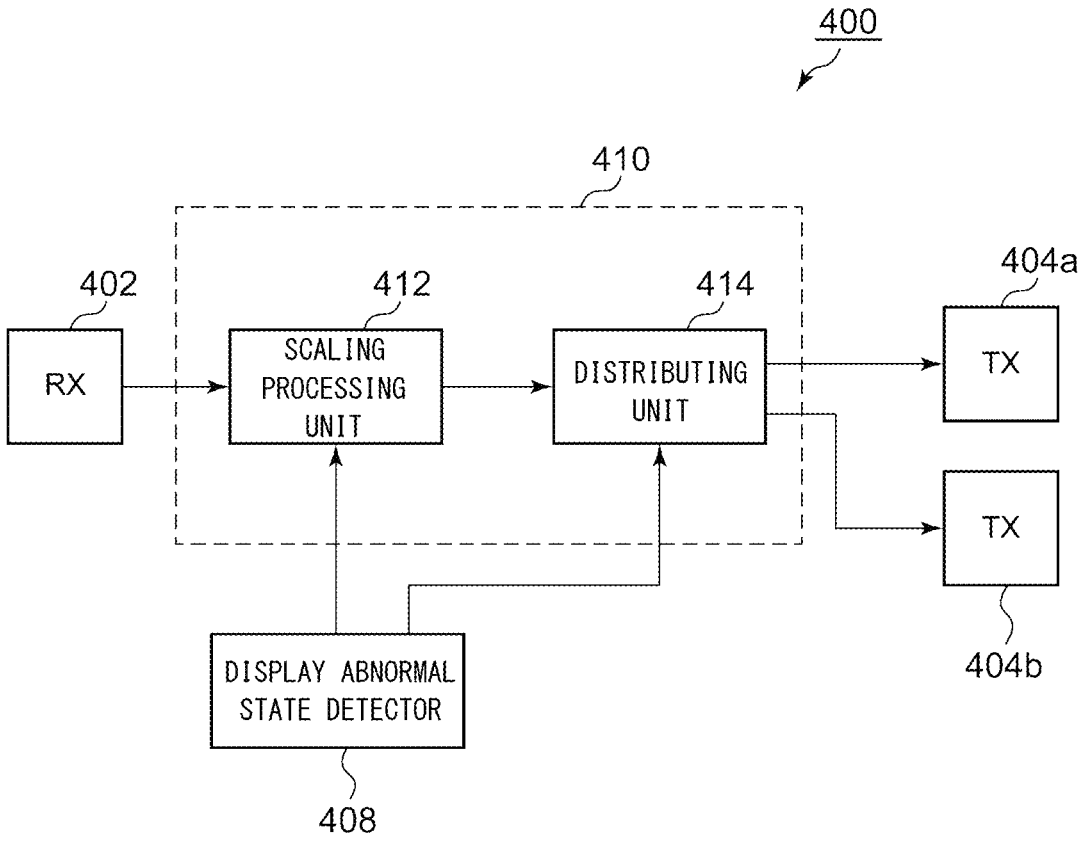
FIG. 9 is a block diagram showing a specific example configuration of the timing controller.

FIG. 9 is a block diagram showing a specific example configuration of the semiconductor apparatus 400. The signal processing unit 410 includes a scaling processing unit 412 and a distributing unit 414. The scaling processing unit 412 includes a line buffer or frame buffer, and stores a part of or the whole of the video data (i.e., line data or frame data) received by the receiver 402.

When the display abnormal state detector 408 detects no abnormal state, the scaling processing unit 412 outputs the video data received by the receiver 402 as it is. When the display abnormal state detector 408 detects an abnormal state, the scaling processing unit 412 scales (or rearranges) the line data or the frame data using any one from among the methods shown in FIG. 8B through FIG. 8D. For example, in a case in which an image is scaled by a factor of ½ in the horizontal direction as shown in FIG. 8B, pixel thinning-out may be employed. Also, calculation processing may be executed so as to integrate adjacent each pair of pixels into a single pixel.

The video data thus scaled or the original data that has not been scaled is input to the distributing unit 414 configured as a downstream stage. The distributing unit 414 receives, as its input, a signal that indicates whether or not an abnormal state has occurred in any one of the source drivers 106. When all the source drivers 106 are operating normally, the distributing unit 414 distributes the original video data output from the scaling processing unit 412 to the transmitters 404*a* and 404*b*. When an abnormal state has been detected in the source driver 106 #, the distributing unit 414 distributes the scaled video data output from the scaling processing unit 412 to the transmitter 404 #! that corresponds to the source driver 106 #! which is operating normally.

As described above, the number of the source drivers 106 may be three or more. FIG. 10A through FIG. 10D are diagrams for explaining the operation of the semiconductor apparatus 400 including the display panel 102 divided into four regions RGNa through RGNd and four source drivers 106*a* through 106*d*.

Figure 10A:
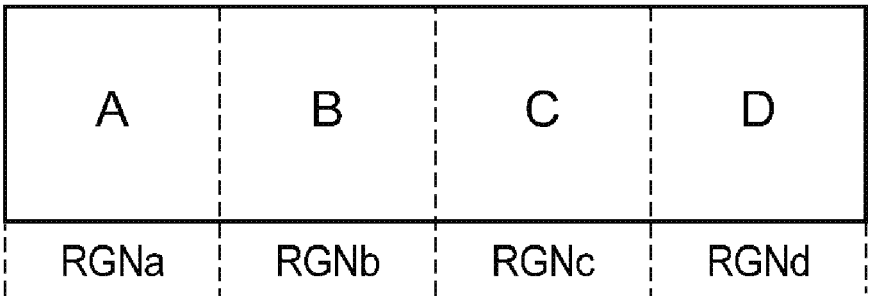
FIG. 10A through FIG. 10D are diagrams for explaining the operation of the timing controller in a case in which a display panel is divided into four regions RGNa through RGNd and is provided with four source drivers.

FIG. 10A shows the frame data when all the source drivers 106*a* through 106*d* are operating normally. Images A through D are displayed in the regions RGNa through RGNd, respectively.

Figure 10B:
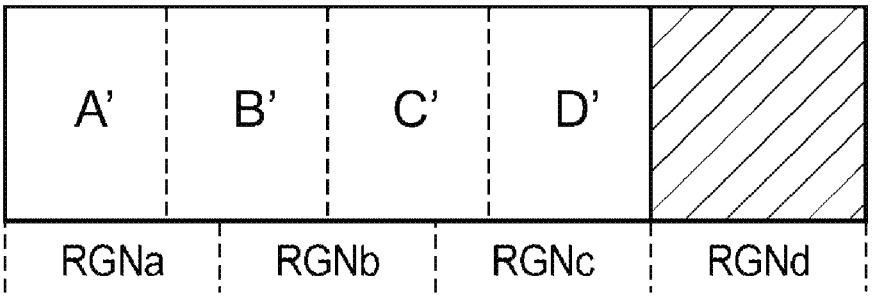
Figure 10C:
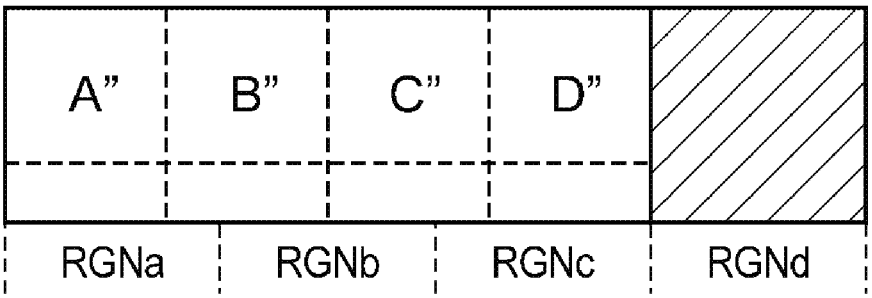
Figure 10D:
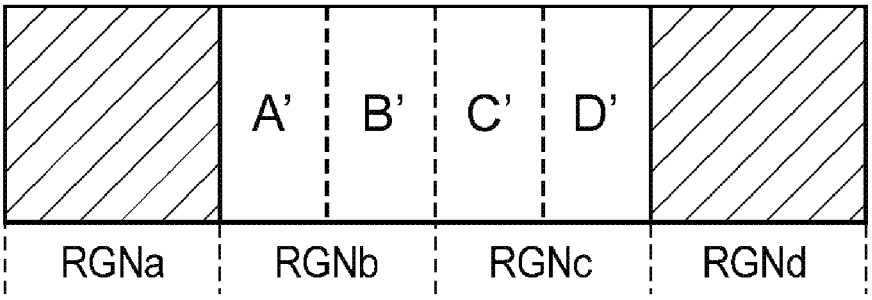

FIG. 10B through FIG. 10D are diagrams for explaining the rearrangement of the video data (line data or frame data) when an abnormal state has been detected. Description will be made regarding an example in which an abnormal state has been detected in the source driver 106*d*, leading to a situation in which no image can be displayed in the region RGNd. With an example, as shown in FIG. 10B, the images A through D may be scaled by a factor of ¾ in only the horizontal direction. The images A' through D' thus scaled may be rearranged in the regions RGNa through RGNc which are operating normally.

With another example, as shown in FIG. 10C, the images A through D may be scaled by a factor of ¾ in both the horizontal direction and the vertical direction so as to maintain the same aspect ratio as that of the original images A through D. The images A" through D" thus scaled may be rearranged in the regions RGNa through RGNc which are operating normally.

With yet another example (not shown), the processing that corresponds to that shown in FIG. 8D may be supported. That is to say, the original images A through C are laid out as they are in the regions RGNa through RGNc which are operating normally. Also, the image D to be displayed in the region RGNd in which an abnormal state has occurred may be scaled. Also, the image D thus scaled may be overlayed on any one from among the regions RGNa through RGNc.

FIG. 10D shows an example in which an abnormal state has been detected in the source drivers 106*a* and 106*d*. In this case, the images A through D may be scaled by a factor of ½ in the horizontal direction, and the images A' through D' thus scaled may be laid out in the regions that are operating normally.

It should be noted that the technique described in the second embodiment can be combined with the technique described in the first embodiment, which is encompassed in the scope of the present disclosure.

Third Embodiment

Figure 11:
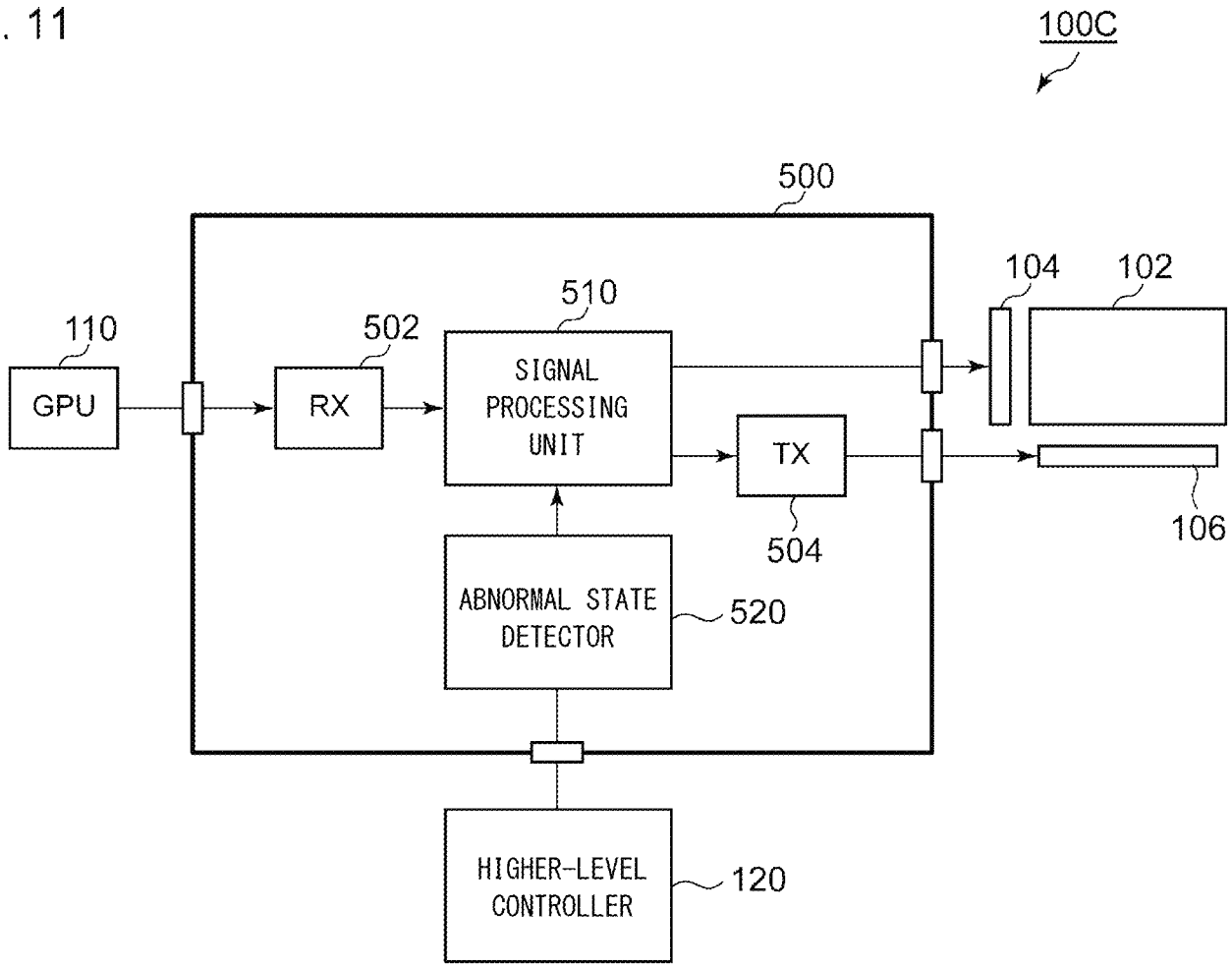
FIG. 11 is a block diagram showing an image display system according to a third embodiment.

FIG. 11 is a block diagram showing an image display system 100C according to a third embodiment. The image display system 100C includes a display panel 102, a gate driver 104, a source driver 106, a graphics processor 110, a higher-level controller 120, and a semiconductor apparatus 500. The higher-level controller 120 is configured as a controller that integrally controls a device or an apparatus including the image display system 100C or a controller that integrally controls a part of the operation of or the entire operation of an automobile.

As described in the first embodiment, the graphics processor 110 and the semiconductor apparatus 500 may be coupled via two transmission channels. Also, as described in the second embodiment, multiple source drivers 106 may be provided.

The semiconductor apparatus 500 is configured as a timing controller, and includes a receiver 502, a transmitter 504, a signal processing unit 510, and an abnormal state detector 520. The semiconductor apparatus 500 may include two transmitters 504 that correspond to the two transmission channels. Also, the semiconductor apparatus 500 may include multiple transmitters 504 that correspond to the multiple source drivers 106.

The signal processing unit 510 processes the video data received by the receiver 502. The transmitter 504 transmits the video data (line data) thus processed to the source driver 106.

The abnormal state detector 520 is coupled to the higher-level controller 120. The abnormal state detector 520 may receive notice of the occurrence of an abnormal state detected by the higher-level controller 120. The kind of the abnormal state to be detected by the higher-level controller 120 is not restricted in particular. Examples of such abnormal states may include a malfunction and an abnormal state that occurs in a peripheral device.

When the abnormal state detector 520 detects an abnormal state, the signal processing unit 510 changes the color appearance (color tone, color temperature, etc.) or the luminance of the video data from the color appearance or the luminance in a normal state. In a case of changing the color appearance or luminance, at least one from among the RGB values may be changed using a predetermined calculation expression or with reference to a table.

With conventional techniques, a method is known in which, in a case in which the user is to be notified of the occurrence of an abnormal state, an icon or the like is displayed on a display using an On Screen Display (OSD) function. However, such a method has a problem of involving the occurrence of missing information in a region where the icon overlaps. In contrast, in a case in which, when an abnormal state has been detected, the color appearance or the luminance is changed, this arrangement is capable of notifying the user of the occurrence of an abnormal state while preventing the occurrence of missing information.

Figure 12A:
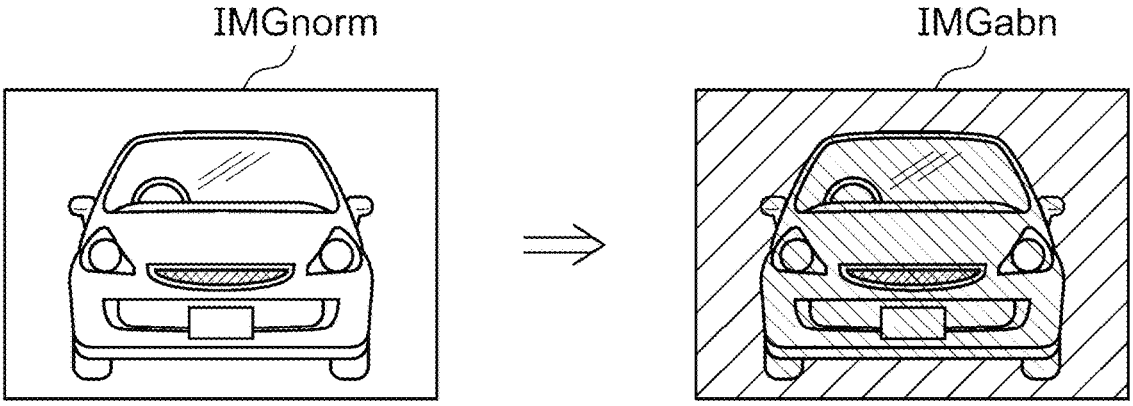
FIG. 12A and FIG. 12B are diagrams for explaining the operation of the image display system.
Figure 12B:
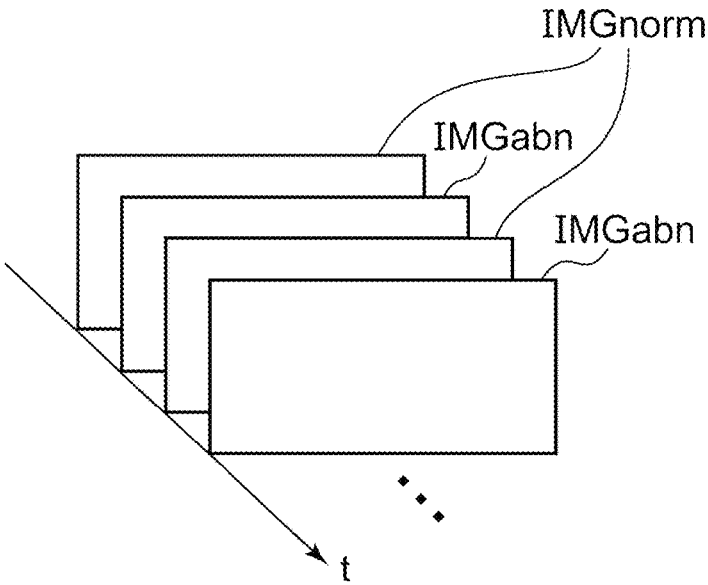

FIG. 12A and FIG. 12B are diagrams for explaining the operation of the image display system 100C. FIG. 12A shows an example of a display image IMGnorm in the normal state and an example of a display image IMGabn in an abnormal state. The signal processing unit 510 may change the color appearance or luminance over time. For example, as shown in FIG. 12B, when an abnormal state has been detected, the color appearance/luminance to be set in the normal state and the color appearance/luminance to be set in the abnormal state may be switched in a time-sharing manner. This allows the user's attention to be further attracted.

The third embodiment may be combined with the first embodiment. In this case, the abnormal state detector 520 corresponds to the reception abnormal state detector 306 described in the first embodiment. The abnormal state detector 520 may detect the occurrence of an abnormal state in video data transmission from the graphics processor 110.

Also, the third embodiment may be combined with the second embodiment. In this case, the abnormal state detector 520 corresponds to the display abnormal state detector 408 described in the second embodiment. The abnormal state detector 520 may detect the occurrence of an abnormal state in the source driver 106.

Description has been made in the embodiments regarding an arrangement in which the semiconductor apparatuses 300, 400, and 500 are each configured as a timing controller. However, the kind of such a semiconductor apparatus is not restricted in particular. Also, the semiconductor apparatus may be configured as a bridge chip or a one-chip driver having a configuration in which a driver and a timing controller are integrated.

For example, the semiconductor apparatus 300 according to the first embodiment may further include the source drivers 106 as built-in components, thereby allowing the semiconductor apparatus 300 to be configured as a one-chip driver. Also, the semiconductor apparatus 300 may be configured as a bridge chip. In this case, the output side of the bridge chip is coupled to another bridge chip or a timing controller.

Also, the semiconductor apparatuses 300 through 500 may receive video data via a bridge chip instead of directly receiving the video data from the graphics processor 110.

Figure 13:
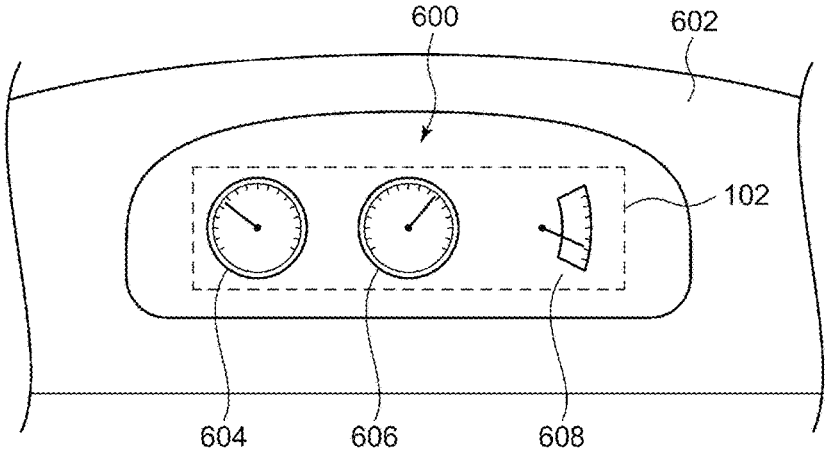
FIG. 13 is a diagram showing an in-vehicle display apparatus.

The image display system 100 described above may be employed as an in-vehicle display. FIG. 13 is a diagram showing an in-vehicle display apparatus 600. The in-vehicle display apparatus 600 is embedded in a console 602 on a front face of a cockpit. The in-vehicle display apparatus 600 receives video data including speedometer data 604, tachometer data 606 indicating the rotational speed of an engine, remaining fuel data 608, and remaining battery charge data in a case in which the vehicle is configured as a hybrid vehicle or an electric vehicle, etc., and displays the items of data thus received.

The timing controllers 300 through 500, which are forms of the semiconductor apparatuses 300 through 500, may each be employed in a medical display apparatus. The medical display apparatus displays necessary information for medical doctors and nurses in a medical examination, medical treatment, or surgery.

Figure 14:
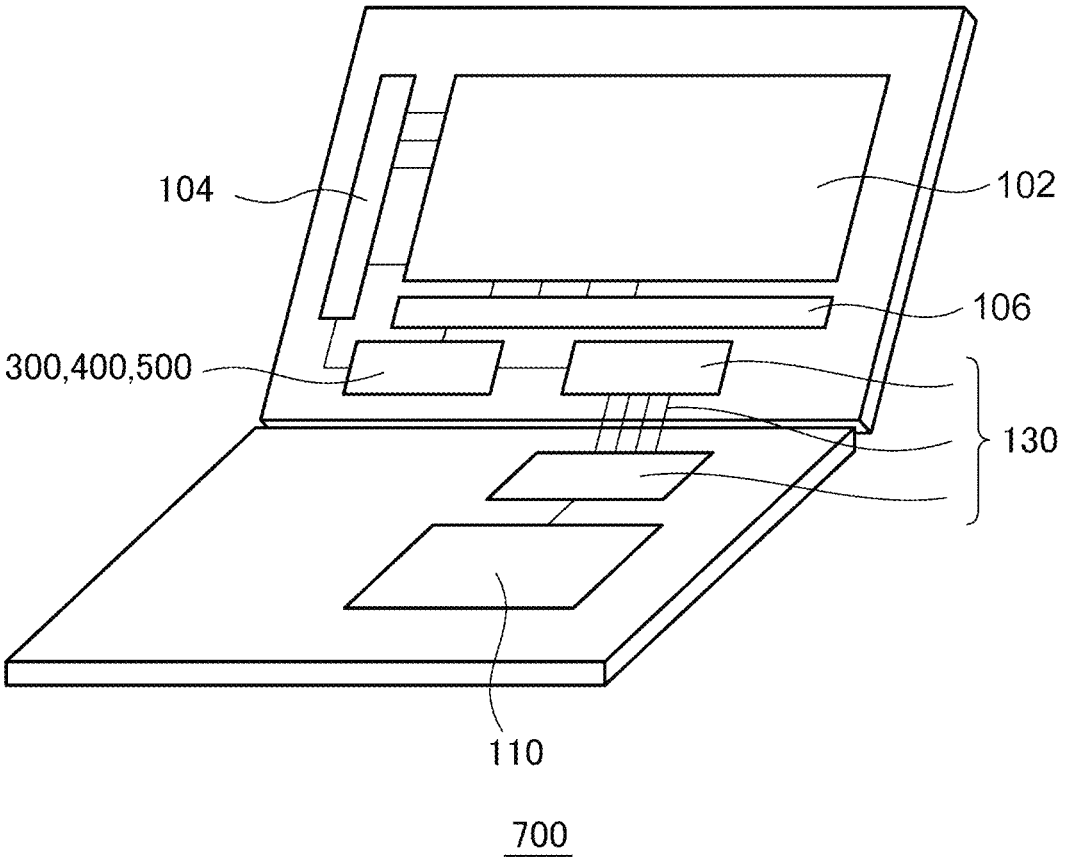
FIG. 14 is a perspective diagram showing an electronic device.

FIG. 14 is a perspective diagram showing an electronic device 700. The electronic device 700 shown in FIG. 14 may be configured as a consumer device such as a laptop computer, tablet terminal, smartphone, portable game machine, audio player, etc. The electronic device 700 includes a graphics controller 110, a display panel 102, a gate driver 104, and a source driver 106, which are built in its housing. Also, a transmission apparatus 130 including a differential transmitter (bridge chip), a transmission path, and a differential receiver (bridge chip) may be provided between the timing controller 200 and the graphics controller 110.

Description has been made regarding the present disclosure with reference to the embodiments using specific terms. However, the above-described embodiments show only the mechanisms and applications of the present disclosure for exemplary purposes only, and are by no means intended to be interpreted restrictively. Rather, various modifications and various changes in the layout can be made without departing from the spirit and scope of the present disclosure defined in appended claims.

What is claimed is:

1. A semiconductor apparatus comprising:

a first receiver structured to receive serial data including data of a plurality of odd-numbered pixels positioned at odd-numbered positions in a horizontal direction in a frame;

a second receiver structured to receive serial data including data of a plurality of even-numbered pixels positioned at even-numbered positions in the horizontal direction in a frame;

a signal processing unit structured to integrate the data of the plurality of odd-numbered pixels and the data of the plurality of even-numbered pixels, so as to generate line data;

a first reception abnormal state detector structured to detect an abnormal state that occurs in the first receiver; and a second reception abnormal state detector structured to detect an abnormal state that occurs in the second receiver, wherein, when the first reception abnormal state detector detects an abnormal state, the signal processing unit restores the data of the odd-numbered pixels using the data of the even-numbered pixels, and wherein, when the second reception abnormal state detector detects an abnormal state, the signal processing unit restores the data of the even-numbered pixels using the data of the data of the odd-numbered pixels.

2. The semiconductor apparatus according to claim 1, wherein (i) when the first reception abnormal state detector detects an abnormal state, the signal processing unit restores the odd-numbered pixels such that, as a restored value of an odd-numbered pixel, a value of an even-numbered pixel adjacent to the corresponding odd-numbered pixel is employed, and wherein (ii) when the second reception abnormal state detector detects an abnormal state, the signal processing unit restores the even-numbered pixels such that, as a restored value of an even-numbered pixel, a value of an odd-numbered pixel adjacent to the corresponding even-numbered pixel is employed.

3. The semiconductor apparatus according to claim 1, wherein (i) when an abnormal state is detected in the first receiver, the signal processing unit restores the odd-numbered pixels such that, as a restored value of an odd-numbered pixel, a value obtained by calculating values of two even-numbered pixels adjacent to the corresponding odd-numbered pixel is employed, and wherein (ii) when an abnormal state is detected in the second receiver, the signal processing unit restores the even-numbered pixels such that, as a restored value of an even-numbered pixel, a value obtained by calculating values of two odd-numbered pixels adjacent to the corresponding even-numbered pixel is employed.

4. The semiconductor apparatus according to claim 1, wherein the serial data is transmitted together with a clock signal, and wherein the first reception abnormal state detector and the second reception abnormal state detector are each structured to detect an abnormal state based on the presence or absence of the clock signal and/or a frequency of the clock signal.

5. The semiconductor apparatus according to claim 1, wherein the first reception abnormal state detector and the second reception abnormal state detector are each structured to detect an abnormal state based on a predetermined code included in the serial data.

6. The semiconductor apparatus according to claim 5, wherein the predetermined code is a synchronization code to be used for link training.

7. The semiconductor apparatus according to claim 5, wherein the predetermined code is a unique code included in each blank period.

8. The semiconductor apparatus according to claim 1, further comprising:

a plurality of transmitters structured to transmit the line data to a plurality of source drivers; and a display a normal state detector structured to detect whether or not an abnormal state occurs in each of the plurality of source drivers, wherein the signal processing unit rearranges the line data on a display panel in a region other than a region in which an abnormal state has been detected so as to distribute the line data thus rearranged to transmitters that correspond to source drivers that are operating normally.

9. The semiconductor apparatus according to claim 8, wherein the signal processing unit scales the line data, and distributes the line data thus scaled to the transmitters that correspond to the source drivers that are operating normally.

10. The semiconductor apparatus according to claim 1, wherein, when either the first reception abnormal state detector or the second reception detector detects an abnormal state, the signal processing unit changes a color appearance or luminance of the line data.

11. A display apparatus comprising the semiconductor apparatus according to claim 1.

12. An in-vehicle display system comprising the semiconductor apparatus according to claim 1.

13. A semiconductor apparatus comprising:

a receiver structured to receive video data;

a signal processing unit structured to process the video data;

a plurality of transmitters structured to transmit the video data processed by the signal processing unit to a plurality of source drivers; and a display abnormal state detector structured to detect whether or not an abnormal state occurs in each of the plurality of source drivers, wherein the signal processing unit rearranges the video data on a display panel in a region other than a region in which an abnormal state is detected, so as to distribute the video data thus rearranged to transmitters that correspond to source drivers that are operating normally.

14. The semiconductor apparatus according to claim 13, wherein the signal processing unit scales the video data, and distributes the video data thus scaled to the transmitters that correspond to the source drivers that are operating normally.

15. The semiconductor apparatus according to claim 13, wherein, when the display abnormal state detector detects an abnormal state, the signal processing unit changes a color appearance or luminance of the video data.

* * * * *